US010783858B2

(12) United States Patent
Burch

(10) Patent No.: US 10,783,858 B2
(45) Date of Patent: Sep. 22, 2020

(54) BACKPACKING GUITAR

(71) Applicant: Stephen W. Burch, Camarillo, CA (US)

(72) Inventor: Stephen W. Burch, Camarillo, CA (US)

( * ) Notice: Subject to any disclaimer, the term of this patent is extended or adjusted under 35 U.S.C. 154(b) by 0 days.

(21) Appl. No.: 16/363,083

(22) Filed: Mar. 25, 2019

(65) Prior Publication Data

US 2020/0251075 A1 Aug. 6, 2020

Related U.S. Application Data

(60) Provisional application No. 62/802,030, filed on Feb. 6, 2019.

(51) Int. Cl.
*G10D 1/08* (2006.01)

(52) U.S. Cl.
CPC ..... *G10D 1/08* (2013.01)

(58) Field of Classification Search
CPC ..... G10D 1/08
See application file for complete search history.

(56) References Cited

U.S. PATENT DOCUMENTS

D758,713 S * 6/2016 Bailey, II ..... G10G 7/005 D3/204

FOREIGN PATENT DOCUMENTS

CN 208351904 U * 1/2019 ..... G10D 1/08

* cited by examiner

*Primary Examiner* — Kimberly R Lockett

(57) ABSTRACT

A four-string guitar that is easily usable for backpacking excursions without adding significant weight or taking significant space within the backpack, with a bridge that is placed near the bottom of the main body. The pear-shaped main body allows for additional tone production in a limited acoustical environment. The tone hole placed on the side enables the sound of the guitar to travel upward rather than projecting outward.

1 Claim, 3 Drawing Sheets

BACKPACKING GUITAR

BACKGROUND OF INVENTION

Backpacking enthusiasts who want to bring a guitar on their expeditions do not currently have a viable option. Of the many guitars on the market, none is practical for most backpackers. There are examples of "traveling guitars" which can be disassembled, but these are often bulky and inconvenient to assemble at camp. There is also a guitar marketed by the Martin Guitar Company, that is labeled a "backpacker guitar," but it is too long and heavy to be of practical use to most backpackers. This invention is needed to enable backpackers to have a musical instrument which does add significant weight to the backpack, and does not take up too much room in the backpack.

The term "backpack" in this document refers to a backpack that is used on a camping/backpacking trip. It does not refer to a smaller school-type backpack used for carrying books and school supplies, nor does it refer to a musical instrument case with straps specifically used to carry a musical instrument.

SUMMARY OF INVENTION

The Backpacking Guitar meets the needs of a backpacker because it is small, lightweight, strong, and has a unique design which enables the guitar to fit easily in most backpacks without having to be disassembled. It is therefore suitable for backpacking enthusiasts who want to play music while on a backpacking excursion.

Figure 1:
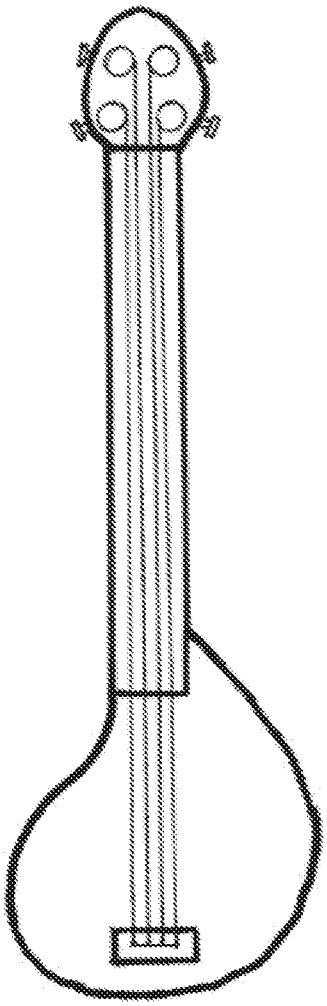
FIG. 1 of 3—Front view of Backpacking Guitar (frets not shown). No patent request is being made for the pear shape of the main body of the Guitar.
Figure 2:
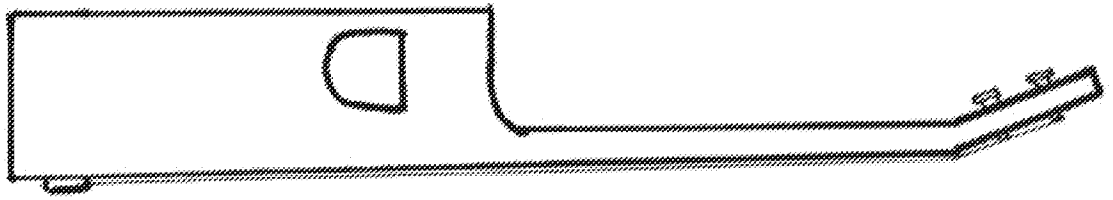
FIG. 2 of 3—Side view of Backpacking Guitar (tone hole in the side). No patent request is being made for the tone hole being on the side of the Guitar.
Figure 3:
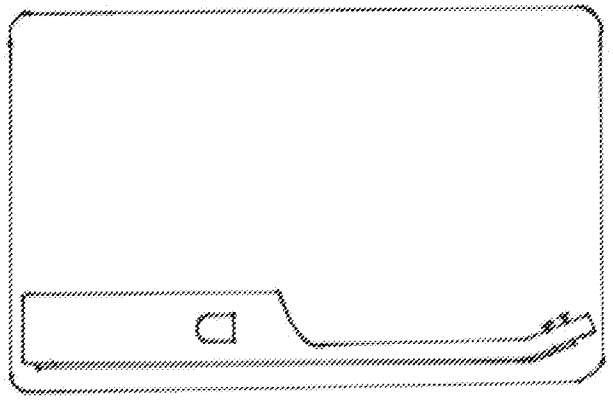
FIG. 3 of 3—Said Backpacking Guitar fits inside a 24-inch deep overnight backpack without having to be disassembled. No patent request is being made for the overnight backpack itself, only for the Backpacking Guitar. The drawing of the overnight backpack does not include the straps, pockets, or other attachments. It shows only the body of the overnight backpack with said guitar inside.

A prototype of the Backpacking Guitar has been constructed. Pictures of the prototype are available upon request by the patent examiner(s) or reviewer(s).

DETAILED DESCRIPTION OF THE INVENTION

The Backpacking Guitar is approximately 23½ inches long, so it fits into a backpack without having to be disassembled. The bridge of the guitar is placed approximately one inch from the end of the main body, rather than in the standard position (lower third of the main body). This allows 15 frets on the guitar, while keeping the entire instrument length at approximately 23½ inches. The tone hole is on the side, rather than the front, of the main body. When the guitar is being played the tone hole faces up, rather than out. This enables the player (and those near her or him) to hear the guitar adequately without being too loud in the camp environment. The main body of the guitar is a pear-shape, rather than a figure-eight shape of standard guitars. This allows for additional tone production in a smaller acoustic environment. The headstock of the guitar is angled at approximately 20 degrees to allow for a shorter overall length.

Not a Baritone Ukulele

This is a four-string guitar, not a baritone ukulele. The baritone ukulele also has four strings, but this backpacking guitar does not have the same strings as a baritone ukulele. The baritone ukulele's four strings are D, G, B, and E. The Backpacking Guitar uses the A string of a standard classical guitar, the D string of a standard classical guitar, the B string of a standard classical guitar, and the E string of a standard classical guitar. This gives the backpacking guitar an effective bass range not available on a baritone ukulele.

Unique Tuning System

The bottom two strings of the four-string guitar that are the A and D strings of a standard classical guitar, tuned to a C and a G (note numbers 48 and 55 according to the International Organization for Standardization ISO System), respectively. The top two strings of the four-string guitar that are the B and high E strings of a standard classical guitar, tuned to C and E (note numbers 60 and 64 according to the International Organization for Standardization ISO System), respectively.

Many non-musician backpacking enthusiasts know little about playing a guitar, and have little interest in learning a series of complex fingering to play different chords. Standard six-string guitar tuning requires a person to learn a different configuration for each different chord. Because of this, I have developed a four-string guitar, with an open-chord tuning system that allows quick and easy learning by someone who has no previous experience playing a guitar.

Using this tuning system, all major chords are played using a single finger, and all minor chords are played using two fingers. The only thing one needs to know is what fret a chord is played on. For example, in standard 6-string guitar tuning, the C major chord fingering pattern is completely different from the E major chord fingering pattern. On my Backpacking Guitar, all major chords have the exact (one finger) pattern. The same hold true for minor chords. For example, in standard 6-string guitar tuning, the C minor chord fingering pattern is completely different from the E minor chord fingering pattern. On the Backpacking Guitar, all minor chords have the exact same two-finger pattern. This opens up the possibility of playing to a broad group of backpacking enthusiasts who don't have the time or motivation to memorize chord patterns and practice playing the instrument.

The invention claimed is:

1. A four-string guitar having a main body; said guitar having length of 23 inches, said length allowing said guitar to fit into a standard 24-inch backpack without having to be disassembled; wherein a bridge of said guitar is approximately one inch or less from a bottom of the main body of said guitar, said length allowing for a twelfth fret on a neck of said guitar to be positioned between a nut of the guitar and the bridge at a mid-point on the guitar body.

* * * * *